United States Patent [19]

Gerhard

[11] 4,098,426

[45] Jul. 4, 1978

[54] DOUBLE-WALLED TRANSPORT CONTAINER FOR FLOWABLE MEDIA

[75] Inventor: Helmut Gerhard, Weitefeld, Sieg, Fed. Rep. of Germany

[73] Assignee: Westerwälder Eisenwerk Gerhard GmbH, Fed. Rep. of Germany

[21] Appl. No.: 734,317

[22] Filed: Oct. 20, 1976

[30] Foreign Application Priority Data

Oct. 29, 1975 [DE] Fed. Rep. of Germany ..... 2548356

[51] Int. Cl.[2] ..... B65D 87/24

[52] U.S. Cl. ..... 220/401; 220/410; 220/444; 220/83; 220/901

[58] Field of Search ..... 280/5 C, 5 D, 5 F, 5 G; 220/1.5, 9 A, 9 F, 12, 15, 69, 83 R, 84, 1 B; 248/127, 128, 129, 146

[56] References Cited

U.S. PATENT DOCUMENTS

| | | | |
|---|---|---|---|
| 2,146,960 | 2/1939 | Kuss | 280/5 G |
| 2,237,310 | 4/1941 | Norbom | 280/5 G X |
| 2,259,319 | 10/1941 | Norbom | 280/5 G |
| 2,437,618 | 3/1948 | Schottgen et al. | 280/5 G X |
| 2,714,516 | 8/1955 | Brown | 220/15 X |
| 2,925,934 | 2/1960 | Hampton et al. | 220/15 |
| 3,326,141 | 6/1967 | Graves | 280/5 G |
| 3,390,644 | 7/1968 | Krauskopf | 280/5 G X |
| 3,726,431 | 4/1973 | Botkin | 220/12 |
| 3,730,384 | 5/1973 | Ramme | 220/12 X |
| 3,766,862 | 10/1973 | Heap et al. | 280/5 G X |

FOREIGN PATENT DOCUMENTS

| | | | |
|---|---|---|---|
| 215,319 | 9/1967 | Sweden | 220/9 A |

*Primary Examiner*—Stephen Marcus
*Attorney, Agent, or Firm*—Craig & Antonelli

[57] ABSTRACT

The improved double-walled transport container for transporting liquids and gases which have to be protected against heating or cooling and against mechanical shock, has a fully insulated inner vessel and an outer vessel comprising an upper shell, a lower shell and two dished endwalls. A shock-absorbing and thermally insulating layer is provided between the outer and the inner vessel, and support flanges extend over the entire length of the outer vessel. The sum of the distances between the endwalls of the inner and the outer vessel is at least equal to the distance of the crest of the arch from the edge of an endwall of the outer vessel.

21 Claims, 5 Drawing Figures

Figure 1:
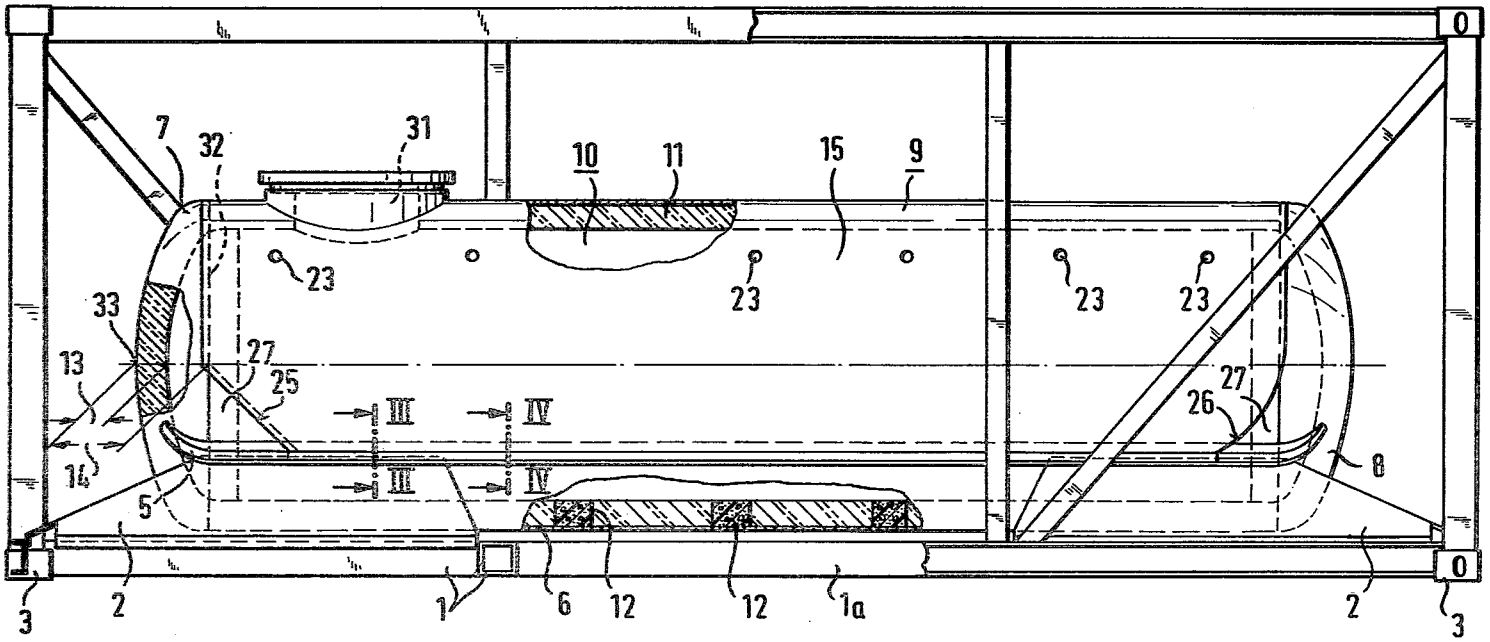

Fig. 2
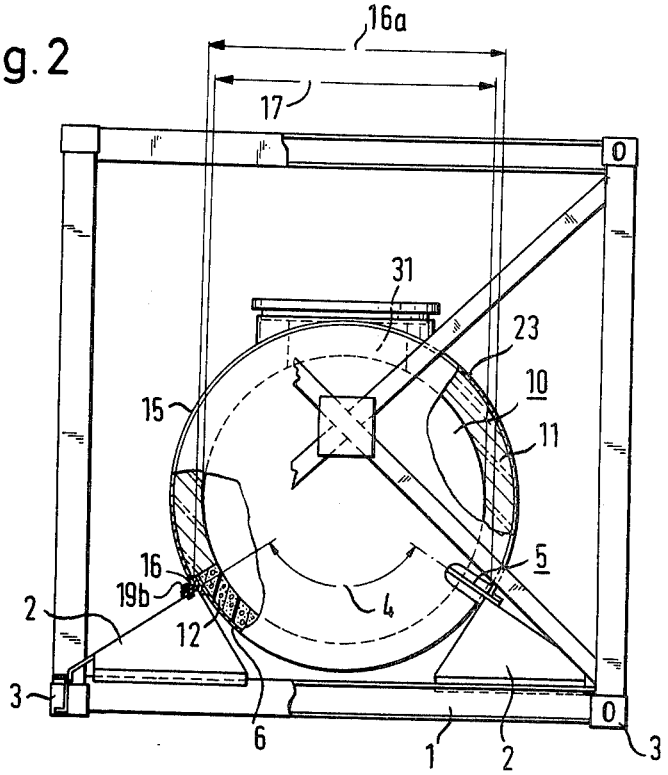
Fig. 3
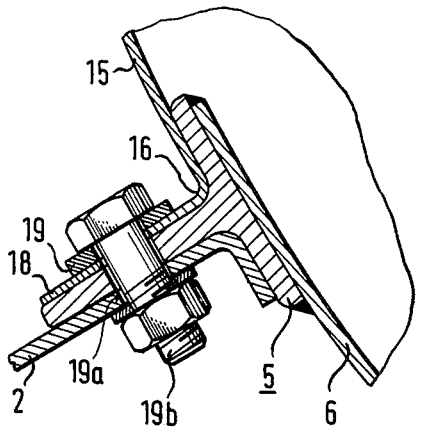
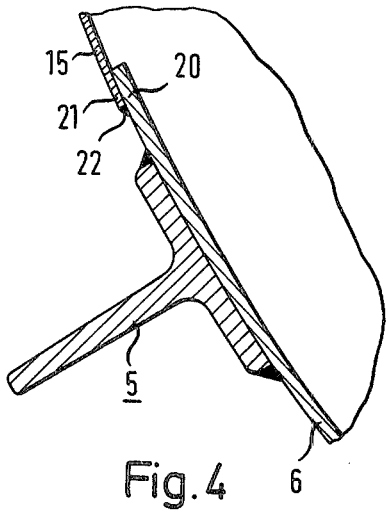
Fig. 4

DOUBLE-WALLED TRANSPORT CONTAINER FOR FLOWABLE MEDIA

For transporting liquids and gases it is necessary in many cases to use vessels, whose liquid or gaseous contents have to be protected against heating or cooling by the environment and against impulse-like mechanical stress. This also applies to so-called transport containers, i.e. vessels of large volume and standardised dimensions, which are provided with corner fittings for stacking and hoisting.

It has been proposed to support the pressure proof cylindrical vessel, required for transporting certain liquids and gases, in a lattice frame, which is, regarding its mechanical characteristics, in accordance with the international standard regulations (ISO1496/III), by means of abutment flanges secured to the vessel and matching saddle members (German utility model 7,439,855).

Thermal insulation of the contents of the vessel is necessary for transporting certain liquids and gases, because frequently temperature variations produce irreversible chemical or qualitative changes in the goods being transported. Protection of the vessel against shock and impulse is essential particularly where the interior surface of the steel vessel is provided with protective linings (e.g. glass or enamel) which, though chemically stable, are sensitive to shock, against attack by the goods being transported, or where the vessel itself consists of a material (e.g. glass fibre reinforced plastics) which is sensitive to impulse and shock. This is all the more relevant since, as is well known, the transport containers are, in the course of their transportation by ship, rail, road and the transfer operations therebetween, regularly subjected to high mechanical stresses.

Frequently also it is not possible to use aluminium vessels which as such are advantageous on account of their low weight and high resistance to attack, on account of the danger of contact corrosion between the aluminium parts and the work made of steel frame. In this connection it must also be considered that transport containers made entirely of aluminium (including the frame work) do not present any advantages over transport containers made of steel so far as weight is concerned, because of the required resistance to buckling.

The requirement that temperature- and contact bridges must be avoided, as well as the requirement for maximum accommodation of impulse- and shock stresses, make it necessary for the closed vessel for flowable media to be, as far as possible, nowhere connected to the container frame via rigid metal elements which introduce stress concentration, at the connection locations, but to be embedded in an insulating mass over as large an area as possible.

Since, on the other hand, the inertia forces arising in the course of container traffic are considerable, the vessel which is exposed to the danger of shock must nevertheless be entirely positively supported.

In the construction of tanker waggons, it has been proposed to support a pressure tight cylindrical container in thermally insulated manner in a trough extending to approximately half the height of the vessel or in a totally enclosed outer vessel; the trough or the outer vessel are then in their turn secured to the waggon frame (publication No. 4508.80 of 1972 by Messrs. VTG).

The first solution requires a seal extending around the vessel at the level of its centre line, which is mechanically unsatisfactory and frequently becomes leaky in operation. Moreover such a support is not able to stand up to the lateral inertia stresses which occur particularly during transportation by ship.

For the purpose of completely enveloping the inner vessel by an outer vessel, the outer vessel has, in the case of the above-mentioned second solution, been divided at the level of its centre line ino two approximately equal halves, so that the inner vessel can first be inserted into the lower half of the outer vessel, whereupon the upper half thereof can be placed thereon and bolted to the lower half at the line of partition. The seams for the bolts also frequently become leaky in operation and entail an additional stress, which is particularly unsatisfactory on account of the large weight of the empty vessel as compared with the arrangement wherein it is built into an open trough.

The object of the invention is to provide a double-walled transport container of the kind stated having a fully insulated inner vessel, which is designed in a weight-saving manner and entailing low production costs and which nonetheless has a high mechanical strength.

The transport container for flowable media, according to the invention, having a prismatic frame work with corner fittings for stacking and hoisting the container and saddle members arranged in at least the lower corner regions of the latter, as well as a substantially cylindrical pressure type vessel, to the outer sides of which support flanges of T-shaped cross-section are applied which extend longitudinally and which are secured to the saddle members, is characterised in that the vessel has an inner vessel, an outer vessel which is made up of an upper shell, a lower shell and two dome shaped endwalls, and a shock-absorbing and thermally insulating insulation between the outer and the inner vessel, that the support flanges extend over the entire length of the outer vessel and that the sum of the distances between the endwalls of the inner and the outer vessel is at least equal to the distance, measured in the axial direction, from the crest of the dome-shape to the edge of an end wall of the outer vessel.

Thanks to this arrangement, both endwalls may be entirely made from one piece integral with the lower shell or welded thereto, before the inner vessel is inserted through the aperture left between the bottoms of the outer vessel. Thereafter the upper shell may be mounted on the inner vessel from above and joined to the endwalls and the lower shell, before the space between the inner and the outer vessel is charged with foam.

Thanks to the entirely or substantially unpartitioned endwalls, optimum transmission of the axial inertia forces exerted, during transportation, by the inner vessel on the outer vessel, and then via the support flanges to the saddle members of the frame work is achieved. The support flanges which extend from one end to the other increase the rigidity of the outer vessel and effect a satisfactory introduction of the inertia forces, which are transmitted over a large area from the inner vessel to the outer vessel, into the saddle members and thence to the corner fittings.

Preferably the support flanges are applied to the margins of the lower shell. Thereby they prevent distortion of, or relative bending between, the joint seams between the upper and lower shell and consequent leakage therethrough. The joint seams may be constructed in a variety of ways, e.g. in the form of welded seams, bolts or rivets. The margins of the upper shell may also be secured directly to the support flanges, e.g. by means of bolts which also provide the connection between the support flanges and the saddle members.

Figure 5:
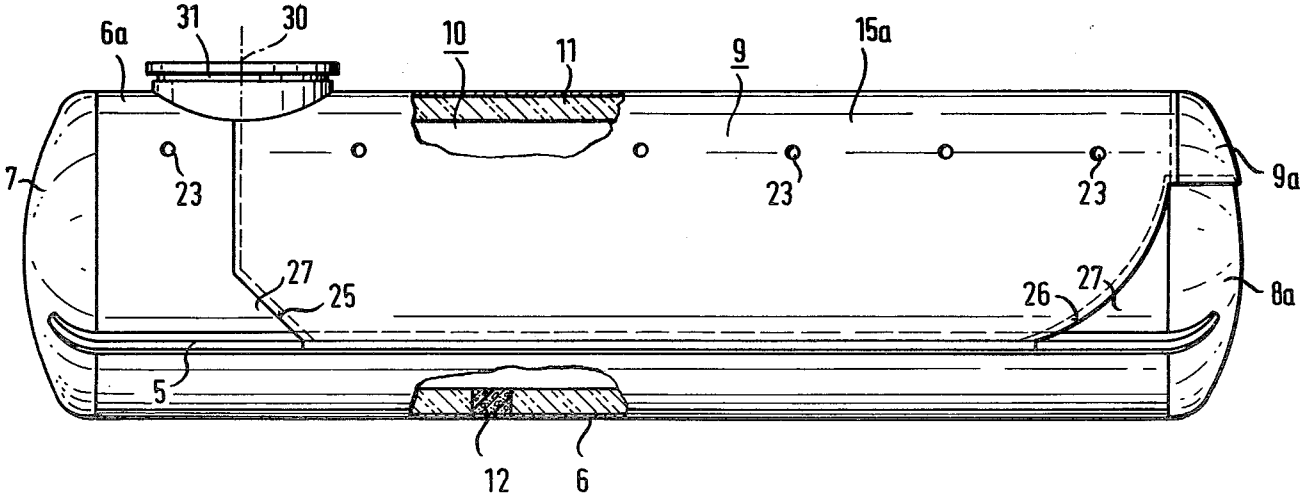

Various embodiments of the invention will now be described with reference to the drawing, in which FIG. 1 is a partly broken away side view of the preferred embodiment of the new transpot container, FIG. 2 is a partly sectioned end view thereof, FIG. 3 is a view of a detail, as seen in the direction of the arrows III—III in FIG. 1, FIG. 4 is a similar representation of a detail of a different construction, as seen in the direction of the arrows IV—IV in FIG. 1 and FIG. 5 is a partly broken away side view of another embodiment, the lattice frame and the saddles having been omitted for sake of clarity.

In accordance with FIGS. 1 to 3, saddle members 2 made of bent sheet metal, are built into the floor configuration of a frame work 1 which complies with the ISO regulations for transport containers. On the saddle members, which introduce all the stresses occurring in operation positively but resiliently into the lower corner fittings 3 of the container frame, the trough-shaped lower shell 6 of an outer vessel 9 is so supported that support flanges of T-shaped cross-section which extend from end to end and are welded along their longitudinal margins rest on the saddle members 2. The outer vessel 9 is made up of a lower shell 6, two domes-shaped endwalls and 8 and an upper shell 15.

Preferably the lower shell 6 is of circular arcuate cross-section whose aperture angel 4 is so chosen that the extensions of the radii passing through its edges and the central limbs of the support flanges 5 meet the lower corner fittings 3 or their longitudinal joints 1*a*. The upper sides of the saddle members 2 are also arranged in the planes determined by these connecting lines, so that the central limbs of the support flanges 5 rest on the saddle members 2 over their entire width. The support flanges and the saddle members are provided with matching bolt holes 19*a*, through which bolts 19*b* may be passed and secured by mating nuts.

The radius of the lower shell 6 and the endwalls 7 and 8 joined thereto is such that the outer vessel can, following its manufacture, encompass an inner vessel 10 at the desired spacing therefrom for the insulation thickness of a mechanical or thermal insulation 11.

Pre-formed shell elements 12 of hard foamed material are inserted into the lower shell 6. The inner vessel 10, which is preferably corrosion resistant (e.g. provided with a glazed surface) can now be mounted on the shell elements.

When the sums of the distances 13 between the endwalls 7, 8 of the outer vessel and those of the inner vessel at the ends is at least equal to the endwall height 14 of the outer vessel, measured between the crest 33 of the dome-shape and the edge 32 of a bottom, then the inner vessel may be inserted obliquely through the aperture remaining between the two outer vessel endwalls 7, 8; in this case both endwalls may thus be made entirely integrally formed as one piece with the lower shell 6 or welded to the latter. This arrangement has the advantage that it provides optimum transmission of the axial inertia forces exerted by the inner vessel into the lower shell of the outer vessel and thence via the support sections to the saddle members.

If, for certain reasons, the insulation thickness 11 is reduced, then one of the bottoms 8*a* may, as shown in FIG. 5, be provided with a cut-out portion, which is covered by a segment 9*a* which is secured to the upper shell 15*a*. In this case it is also possible for a portion 6*a* of the upper shell of the outer vessel, which is adjacent to the other bottom 7, to be made integral with the lower shell, or welded thereto. This shell portion 6*a* preferably extends to the centre 30 of the manhole 31 of the inner vessel, in order that this critical region may be especially protected.

In order to achieve uniform distribution of the forces at the outer vessel, it is advisable to provide the transitional regions 27 between the lower shell 6 and the endwalls 7 and 8 of the outer vessel with an oblique portion 25 or a rounded portion 26.

After the inner vessel 10 has been inserted or slid in, the pre-bent upper shell 15 of the outer vessel is slid from above over the cylindrical portion of the inner vessel 10. This is possible because the lower edges 16 of the upper shell are spaced apart by a distance 16*a* which is at least equal to the outer diameter 17 of the inner vessel 10.

The lower edges 16 of the upper shell may be bent outwardly in such a way that form end flanges 78 sitting they sit on the outside of the T-shaped support flange 5 which extends over the entire length of the vessel from endwall to endwall. Clamping brackets 19 are secured above the saddle members 2, the support flanges 5 and the end flanges 18 of the upper shell 15, and are held by means of the bolts 19*b* in juxtaposition with the end flanges 18 of the upper shell, the support flanges 5 and the saddles 2. The clamping brackets 19 serve the purpose of providing a screw press effect throughout and of preventing yielding of the end flanges 18 of the upper shell.

The bolts 19*b* thus connect the saddle members 2 positively with the lower shell 6 via the support flanges 5 which are secured to the latter, as well as with the end flanges 18 and the clamping brackets 19.

Other ways of securing the edges of the upper shell are however also conceivable. In this case bending of the lower edges of the upper shell can be dispensed with. In accordance with FIG. 4, for example, the edges 20 of the lower shell 6 protrude to a certain extent beyond the support flange 5. The straight lower edges 21 of the upper shell 15 are then lap welded to the edges 20 of the lower shell, which are also straight, at 22 (FIG. 4), or riveted together. Incidentally, in order to achieve a greater degree of rigidity, all these securing means may also be applied at the upper limb of the support flange 5 instead of the edge 20 of the sheet metal lower shell 6.

Through an appropriate number of foaming apertures 23, the space which has remained free between the inner vessel 10, the shell elements 12 and the outer vessel 9 is charged with a foamed insulating material 11. A suitable insulating material is preferably a foamed material which sets in a pressure-proof manner, e.g. polyurethane. The foaming, as well as the sealing of the vessel connections which are provided on the crest line and which have remained free is carried out in known manner.

The wall thickness of the lower shell 6 may be different from that of the upper shell 15, 15*a*, since the lower shell 6 is statically stressed by the total weight of the inner vessel and moreover has to accommodate and transmit to the floor configuration of the work frame 1 dynamic horizontal transverse and longitudinal forces, whilst the upper shell only has to accommodate components of the transverse and longitudinal forces when in motion.

I claim:

1. A double-wallet transport container for flowable media, comprising a prismatic framework having corner fittings for stacking and hoisting the container and saddle members arranged in at least the lower corner regions of the latter; a substantially cylindrical pressure-proof receptacle; support flanges applied to the outer sides of the latter, said support flanges extending longitudinally and being secured to the saddle members, the receptacle comprising an inner vessel, an outer vessel, said outer vessel comprising an upper shell, a lower shell and two dome-shaped endwalls which are formed as one piece with the lower shell, and a shock-absorbing and thermally insulating layer between the outer and the inner vessel, the support flanges being so constructed that they extend over the entire length of the outer vessel and the sum of the distances between the endwalls of the inner and the outer vessel being at least equal to the distance, measured in the axial direction of the receptacle, from the crest of the dome-shape to the edge of an endwall of the outer vessel.

2. A transport container according to claim 1, wherein the mutual spacing of the edges of the lower shell of the outer vessel is less than the diameter of the upper shell of the latter, but not less than the diameter of the inner vessel.

3. A transport container according to claim 1, wherein the support flanges are applied to the edges of the lower shell of the outer vessel.

4. A transport container according to claim 3, wherein the upper shell is secured by its edges substantially at the support flanges.

5. A transport container according to claim 4, wherein the edges of the upper shell are bent outwardly and bolts are provided to hold said edges together with the support flanges and the saddle members.

6. A transport container according to claim 5, including clamping brackets and wherein the upper shell edges are clamped between said clamping brackets and the support flanges.

7. A transport container according to claim 3, wherein the edges of the upper shell are secured directly to the edges of the lower shell.

8. A transport container according to claim 1, wherein the endwalls of the outer vessel are not partitioned.

9. A transport container according to claim 1, wherein a endwall of the outer vessel has a cut-out portion at its upper end and a cap secured to the upper shell of the outer vessel is provided to cover said portion.

10. A transport container according to claim 9, wherein said inner vessel has a manhole and wherein a portion of the upper shell is integral with that endwall which does not have a cut-out portion and extends to the center of said manhole.

11. A transport container according to claim 1, comprising oblique transition elements between the lower shell and the endwalls of said outer vessel.

12. A transport container according to claim 1, wherein the inner and outer vessels are made of steel.

13. A transport container according to claim 1, wherein the outer vessel is made of steel and the inner vessel is made of a glass fibre reinforced plastics material.

14. A transport container according to claim 1, wherein the outer vessel is made of steel and the inner vessel of aluminium.

15. A transport container according to claim 1, wherein the outer vessel is made of steel and the inner vessel of an aluminium alloy.

16. A double-walled transport container for flowable media, comprising a pressure-proof receptacle; the receptacle comprising an inner vessel, an outer vessel, said outer vessel comprising an upper shell, a lower shell and two dome-shaped endwalls formed as one piece with the lower shell, and a shock-absorbing and thermally insulating layer between the outer and the inner vessel.

17. A transport container according to claim 16, wherein an endwall of the outervessel has a cut-out portion at its upper end and a cap secured to the upper shell of the outer vessel is provided to cover said portion.

18. A transport container according to claim 17, wherein said inner vessel has a manhole and wherein a portion of the upper shell is integral with that endwall which does not have a cut-out portion and extends to the center of said manhole.

19. A transport container according to claim 16, comprising oblique transition elements between the lower shell and the endwalls of said outer vessel.

20. A double-walled transport container for flowable media, comprising a prismatic lattice frame having corner fittings for stacking and hoisting the container and saddle members arranged in at least the lower corner regions of the latter; a substantially cylindrical pressure-proof receptacle; support flanges applied to the outer sides of the latter, said support flanges extending longitudinally and being secured to the saddle members, the receptacle comprising an inner vessel, an outer vessel, said outer vessel comprising an upper shell, a lower shell and two dome-shaped endwalls, and a shock-absorbing and thermally insulating layer between the outer and the inner vessel, the support flanges being so constructed that they extend over the entire length of the outer vessel and the sum of the distances between the endwalls of the inner and the outer vessel being at least equal to the distance, measured in the axial direction of the receptacle, from the crest of the dome-shape to the edge of an endwall of the outer vessel wherein an endwall of the outer vessel has a cut-out portion at its upper end and a cap secured to the upper shell of the outer vessel is provided to cover said portion.

21. A double-walled transport container for flowable media, comprising a prismatic lattice frame having corner fittings for stacking and hoisting the container and saddle members arranged in at least the lower corner regions of the latter; a substantially cylindrical pressure-proof receptacle; support flanges applied to the outer sides of the latter, said support flanges extending longitudinally and being secured to the saddle members, the receptacle comprising an inner vessel, an outer vessel, said outer vessel comprising an upper shell, a lower shell and two dome-shaped endwalls, and a shock-absorbing and thermally insulating layer between the outer and the inner vessel, the support flanges being so constructed that they extend over the entire length of the outer vessel and the sum of the distances between the endwalls of the inner and the outer vessel being at least equal to the distance, measured in the axial direction of the receptacle, from the crest of the dome-shape to the edge of an endwall of the outer vessel and having oblique transition elements between the lower shell and the endwall of said outer vessel.

* * * * *